US008070251B2

(12) United States Patent
Burroughs et al.

(10) Patent No.: US 8,070,251 B2
(45) Date of Patent: Dec. 6, 2011

(54) INKJET PRINTER MAINTENANCE SYSTEM

(75) Inventors: Sarah Marie Burroughs, Lexington, KY (US); Charles Scott McDavid, Frankfort, KY (US)

(73) Assignee: Lexmark International, Inc., Lexington, KY (US)

( * ) Notice: Subject to any disclaimer, the term of this patent is extended or adjusted under 35 U.S.C. 154(b) by 370 days.

(21) Appl. No.: 12/477,372

(22) Filed: Jun. 3, 2009

(65) Prior Publication Data

US 2010/0309245 A1 Dec. 9, 2010

(51) Int. Cl.
*B41J 29/377* (2006.01)
*B41J 2/175* (2006.01)

(52) U.S. Cl. ..... 347/18; 347/85

(58) Field of Classification Search ..... 347/18, 347/84–87

See application file for complete search history.

(56) References Cited

U.S. PATENT DOCUMENTS 5,291,215 A * 3/1994 Nozawa et al. ..... 347/18
7,125,110 B2 * 10/2006 Merz et al. ..... 347/89
7,980,683 B2 * 7/2011 Bansyo ..... 347/85

* cited by examiner

*Primary Examiner* — An Do

(57) ABSTRACT

An inkjet printer maintenance system includes a manifold having an air removal passageway communicating with an ink reservoir, a valve in the manifold actuatable for opening and closing the air removal passageway for periodically drawing out air from the flow of ink in the ink reservoir and a valve actuator in the form of an electrically conductive wire sensitive to change in temperature. In response to application of electric current, and termination of application of electric current, the wire correspondingly contracts and extends in length causing the opening and permitting the closing of the air removal passageway by the valve.

20 Claims, 2 Drawing Sheets

VALVE IN CLOSED POSITION

VALVE IN CLOSED POSITION

VALVE IN OPEN POSITION

INKJET PRINTER MAINTENANCE SYSTEM

BACKGROUND

1. Field of the Invention

The present invention relates generally to inkjet printers and, more particularly to an inkjet printer maintenance system.

2. Description of the Related Art

Thermal inkjet printers apply ink to a print medium by ejecting small droplets of ink from an array of nozzles located in a printhead of a printhead cartridge. An array of thin-film resistors on an integrated circuit on the printhead selectively generates heat as current is passed through the resistors. The heat causes ink contained within an ink reservoir adjacent to the resistors to boil and be ejected from the array of nozzles associated with the resistor array. A printer controller determines which resistors will be "fired" and the proper firing sequence so that the desired pattern of dots is printed on the medium to form an image.

Replacement printhead cartridges include integrated ink reservoirs. These reservoirs often contain less ink than the printhead is capable of ejecting over its life. The useful lifetime of a printhead cartridge can be extended significantly if the integrated ink reservoir can be refilled. Several methods now exist for supplying additional ink to the printhead after the initial supply in the integrated reservoir has been depleted. Most of these methods involve continuous or intermittent siphoning or pumping of ink from a remote ink source to the print cartridge. The remote ink source is typically housed in a replacement ink tank which is "off-carrier," meaning it is not mounted on the carriage which moves the printhead cartridge across the print medium. In an off-carrier ink supply system, the ink usually travels from the remote ink tank to the printhead cartridge through a flexible conduit.

When an off-carrier-ink-tank printer is filled or re-filled with ink, air can inadvertently enter the printhead reservoir with the ink. For the printhead to operate properly, this air must be periodically removed. The current approach for removing this air (maintaining the printhead) is to use a vacuum pump to pull ink and air through the printhead manifold. An arrangement having a gear train actuating a cam system is used to open a spring loaded plunger valve for each individual color reservoir to be serviced. One problem with this arrangement is that it is overly complicated just to perform the simple function of opening the valves.

Consequently, there is a need for an innovation that will overcome the problem associated with removing air when filling or re-filling ink in the prior art inkjet printer systems.

SUMMARY OF THE INVENTION

The present invention provides an innovation in the form of an inkjet printer maintenance system having a valve actuator which, in an exemplary embodiment, uses a temperature sensitive wire designed to satisfy the aforementioned need. The inkjet printing maintenance system of the present invention thus avoids the problem of the prior art device by utilizing a temperature sensitive wire having a contraction or expansion (variation) in length of up to 10 percent in combination with a spring to open the valve for air removal during ink filling or re-filling and then allow the valve to close once the air is removed.

Accordingly, in an aspect of an embodiment of the present invention, an inkjet printer maintenance system comprises a manifold having an elongated air removal passageway defined in the manifold extending between one side of an ink reservoir and a location away from the ink reservoir for communicating flow of air from the ink reservoir for evacuation of air via the air removal passageway, a valve having an elongated bore in communicating with the air removal passageway, a piston movable in the bore between first and second positions to correspondingly close and open the air removal passageway, a biasing member extendible and contractible and biased to normally extend and move the piston to the first position closing the air removal passageway and a valve actuator extending through the elongated bore and connected to the piston. The valve actuator is responsive to the application of an electrical current thereto by contracting and causing the biasing member to contract and the piston to be moved to the second position opening the air removal passageway so air can be drawn out from the ink reservoir. The valve actuator is responsive to the termination of application of the electrical current thereto by extending and allowing the biasing member to extend and move the piston to the first position closing the air removal passageway.

In another aspect of an embodiment of the present invention, the valve actuator includes an electrically-conductive temperature-sensitive wire. The wire extends through the elongated bore and is connected at an inner end to the piston and anchored at an outer end at a fixed position relative to the manifold. The elongated wire is contractible and extendible in length in response correspondingly to application of an electrical current thereto. The termination of application of the electrical current thereto permits the contraction in the length of the wire to contract the biasing member and move the piston to the second position opening the air removal passageway to flow communication for drawing out air from the ink reservoir.

BRIEF DESCRIPTION OF THE DRAWINGS

Figure 1:
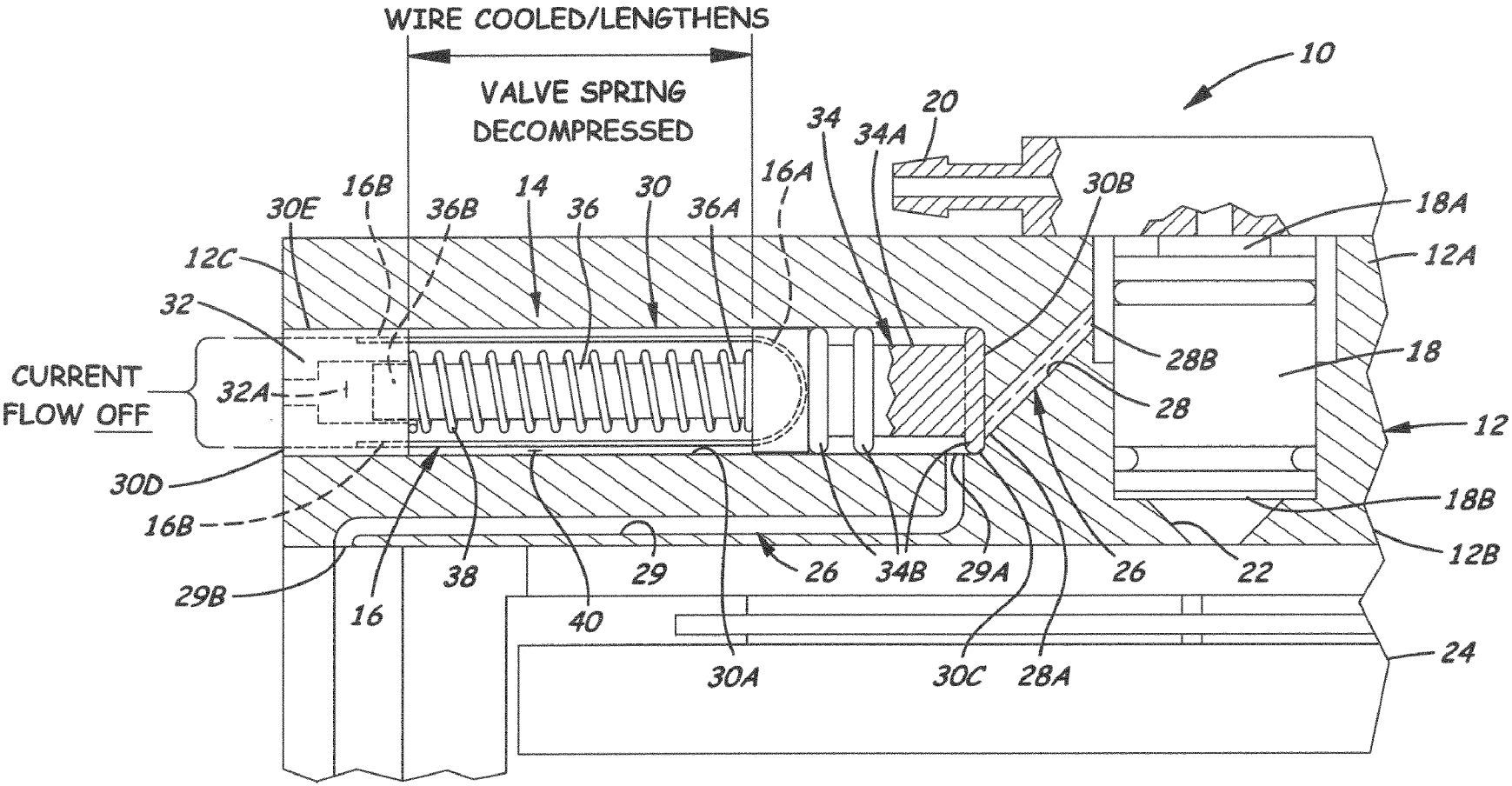

Having thus described the invention in general terms, reference will now be made to the accompanying drawings, which are not necessarily drawn to scale, and wherein:

FIG. 1 is a sectional view of an inkjet printer maintenance system in accordance with the present invention showing a valve of the system in a closed position.

Figure 2:
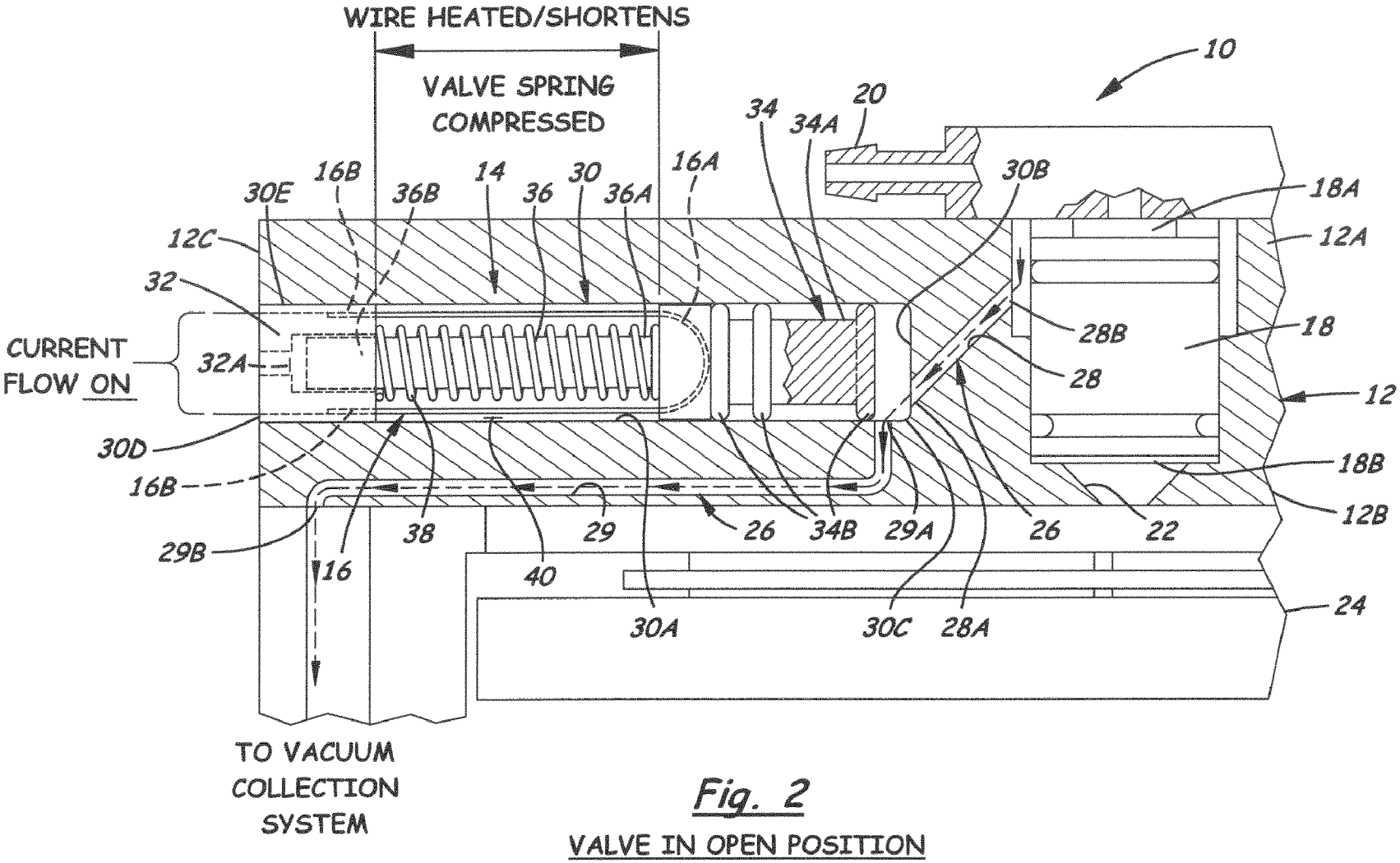

FIG. 2 is a sectional view similar to FIG. 1 but now showing the valve of the inkjet printer maintenance system in an open position.

DETAILED DESCRIPTION

The present invention now will be described more fully hereinafter with reference to the accompanying drawings, in which some, but not all embodiments of the invention are shown. Indeed, the invention may be embodied in many different forms and should not be construed as limited to the embodiments set forth herein, rather, these embodiments are provided so that this disclosure will satisfy applicable legal requirements. Like numerals refer to like elements throughout the views.

Referring now to FIGS. 1 and 2, there is illustrated an exemplary embodiment of an inkjet printer maintenance system of the present invention, generally designated 10. The system 10 basically includes a manifold 12, a valve 14, and a valve actuator 16.

The manifold 12 has an ink reservoir 18 defined in the manifold 12 having an upper inlet end 18A and a lower outlet end 18B. An ink inlet 20 on an upper portion 12A of the manifold 12 is in flow communication with the upper inlet end 18A of the ink reservoir 18. An ink outlet 22 on a lower portion 12B of the manifold 12 is in flow communication with the lower outlet end 18B of the ink reservoir 18. This path of flow communication through the ink reservoir 18 in the manifold 12 allows ink, and inadvertently some air with the ink, to flow from an off-carrier source to an inkjet printhead 24 during an ink filling or re-filling operation by flowing through the ink reservoir 18 of the manifold 12 from the upper inlet end 18A to the lower outlet end 18B of the ink reservoir 18. It is desirable to remove the air as much as possible in order to prevent it from disrupting subsequent ink flow and printhead operation.

Toward this end, an elongated passageway 26 is defined in the manifold 12 for air removal. The air removal passageway 26 extends between one side of the ink reservoir 18 and a location remote from the ink reservoir 18 for removing air from the ink reservoir 18 that inadvertently enters the ink reservoir 18. The air removal passageway 26 has an inner portion 28 at a location on the one side of the ink reservoir 18 that is open for flow communication with the ink reservoir 18 intermediately of the upper inlet end 18A and the lower outlet end 18B of the ink reservoir 18. The air removal passageway 26 also has an outer portion 29 at the location remote from the ink reservoir 18 that is open for flow communication with a vacuum collection system (not shown).

The valve 14 is provided for regulating communication of air flow through the air removal passageway 26 between the ink reservoir 18 and the vacuum collection system. By selective opening and closing of the valve 14, as will be explained hereinafter, air may be periodically removed from the ink reservoir 18 to enable the printhead 24 of the printer (not shown) to operate properly. The components of the valve 14 include an elongated valve bore 30, a bore plug 32, a valve piston 34, a plunger shaft 36, and an elongated spring 38.

The elongated valve bore 30 of the valve 14 located in the manifold 12 has an endless sidewall 30A of a substantially cylindrical configuration and a given diameter along with an inner end wall 30B. The inner end wall 30B is situated at an inner end 30C of the valve bore 30 terminating the endless sidewall 30A near but located in a spaced relationship to the ink reservoir 18. Both the inner end wall 30B and endless sidewall 30A cross and interrupt the air removal passageway 26, at spaced apart locations along the air removal passageway 26, thereby separating the passageway 26 into the inner portion 28 and the outer portion 29.

The inner portion 28 of the air removal passageway 26 has an exit end 28A in the inner end wall 30B of the valve bore 30 communicating with the valve bore 30. Further, the inner portion 28 of the air removal passageway 26 also has an entry end 28B open for flow communication with the ink reservoir 18. The outer portion 29 of the air removal passageway 26 has an entry end 29A in the endless sidewall 30A of the valve bore 30 communicating with the valve bore 30. The entry end 29A of the outer portion 29 is located adjacent to the inner end wall 30B, but spaced from the exit end 28A of the inner portion 28 of the air removal passageway 26 in the inner end wall 30. The outer portion 29 of the air removal passageway 26 has an exit end 29B which is open for flow communication with the vacuum collection system.

Furthermore the elongated valve bore 30 has an opening 30D at an outer end 30E thereof located remote from the ink reservoir 18 and defined on an external surface portion 12C of the manifold 12. The bore plug 32 of the valve 14 is of substantially cylindrical configuration and has an outside diameter to match the diameter of the valve bore 30 enabling the bore plug 32 to snuggly fit through the opening 30D and into the outer end 30E of the valve bore 30. The bore plug 32 also has a central bore 32A extending axially through the plug 32.

Further, the valve piston 34 of the valve 14 has a piston body 34A and a plurality of seal rings 34B spaced apart from one another and surrounding the piston body 34A so as to make slidable sealing contact with the endless sidewall 30A of the valve bore 30. In such manner, the valve piston 34 is mounted in the valve bore 30 for sliding movement along the valve bore 30 between first and second positions to correspondingly close and open the air removal passageway 26. The piston body 34A of the valve piston 34 is of substantially cylindrical configuration and an outside diameter less than the diameter of the valve bore 30 such that an outside surface of the piston body 34A is spaced inwardly from the endless sidewall 30A of the valve bore 30. The seal rings 34B extend around and outwardly from the outside surface of the valve piston body 34A to the endless sidewall 30A of the valve bore 30 so as to make the aforementioned slidable sealing contact with the endless sidewall 30A of the valve bore 30. Using seal rings 34B prevents the valve 14 from opposing the seal between the printhead 24 and the vacuum system.

The plunger shaft 36 of the valve 14 is connected at an inner end 36A to the valve piston body 34A and at an outer end 36B is slidably mounted in the central bore 32A of the valve bore plug 32. The plunger shaft 36 is of a substantially cylindrical configuration and has an outside diameter less than the diameter of the valve bore 30 such that an outside surface of the plunger shaft 36 is spaced inwardly from the endless sidewall 30A of the valve bore 30 so as to define an annular space 40 therebetween.

The elongated spring 38 of the valve 14 is coiled and extends around the plunger shaft 36 of the valve 14 within the annular space 40 around the plunger shaft 36. Also, the spring 38 extends between and is resiliently yieldably disposed against the piston 34 and the bore plug 32. The spring 38 is biased so as to normally exert a force against the valve piston 34 to hold the valve piston 34 against the inner end wall 30B of the valve bore 30, thus closing the exit end 28A of the inner portion 28 of the air removal passageway 26.

The valve actuator 16 of the valve 14 extends along the elongated spring 38 within the annular space 40 and between and connected at its opposite ends to the valve piston 34 and the bore plug 32. The valve actuator 16, in an exemplary for, is an electrically-conductive temperature-sensitive wire 16. The electric current is applied to the wire 16 so as to pass through it and cause the wire 16 to increase in temperature and thereby contract in length (or shorten). This contraction in the length of the valve actuator wire 16 causes contraction of the spring 38 by pulling the valve piston 34 away from the inner end wall 30B of the valve bore 30 through a sufficient displacement. The displacement of the valve piston 34 opens the exit end 28A of the inner portion 28 of the air removal passageway 26 to flow communication with the entry end 29A of the outer portion 29 of the air removal passageway 26 and thereby open flow communication of the vacuum collection system with the ink reservoir 18 for drawing out air from the ink reservoir 18 via the air removal passageway 26.

The valve actuator wire 16 is also adapted to respond to the termination of the application of electric current to it by decreasing in temperature or cooling and thereby expanding in length (or lengthen). This expansion in the length of the valve actuator wire 16 enables the normal biased return extension of the spring 38 to normally move the valve piston 34 against the inner end wall 30B of the valve bore 30. The movement of the valve piston 34 closes the exit end 28A of the inner portion 28 of the air removal passageway 26 to flow communication with the entry end 29A of the outer portion 29 of the air removal passageway 26 and thereby close flow communication of the vacuum collection system with the ink reservoir 18 for terminating drawing out of air from the ink reservoir 18 via the air removal passageway 26.

The valve actuator wire 16 in an exemplary embodiment has a U-shaped configuration so as to define an inner bight portion 16A where the wire 16 is connected to the valve piston 34 and a pair of outer end portions 16B where the wire 16 extends through the bore plug 32 for connection of the outer end portions 16B of the wire 16 to a source of electric current (for example 400 mA), such as from an on-carrier ASIC (Application Specific Integrated Circuit) of the printer. The electrically-conductive material of the temperature sensitive valve actuator wire 16 may be, for example Nitinol, an alloy of nickel and titanium. Properties of Nitinol include low force and low cycles which are desired properties of the valve actuator wire 16 in the inkjet printer maintenance system 10. Nitinol being an alloy of nickel and titanium is among a group of metals which performs a transformation between austenitic and martensitic phases at relatively low temperatures ranging from 50 to 110 degrees C. For Nitinol wires, this transformation results in a change in length of up to 10 percent. When the wire 16 is heated to its transformation temperature when current is run through the wires the wire contracts 2 to 10 percent of its original length. The amount of contraction strain depends on the wire configuration design. When the wire 16 is allowed to cool, by removing current, to below the transformation temperature, the wire returns to its original length. Actuation time is near instantaneous and recovery (cool down to closure) is approximately 1 second. Some advantages of using temperature sensitive wire is the relatively low manufacturing cost, long life, corrosion resistant, and is compatible with inks The foregoing description of several embodiments of the invention has been presented for purposes of illustration. It is not intended to be exhaustive or to limit the invention to the precise forms disclosed, and obviously many modifications and variations are possible in light of the above teaching. It is intended that the scope of the invention be defined by the claims appended hereto.

What is claimed is:

1. An inkjet printer maintenance system, comprising:

a manifold having an elongated air removal passageway defined in the manifold extending between one side of an ink reservoir and a location away from the ink reservoir for communicating flow of air from the ink reservoir via the air removal passageway;

a valve having an elongated bore communicating with the air removal passageway, a piston movable in the bore between first and second positions to correspondingly close and open the air removal passageway, and a biasing member extendible and contractible and biased to normally extend and move the piston to the first position closing the air removal passageway; and a valve actuator extending through the elongated bore and connected to the piston, the valve actuator responsive to the application of an electric current thereto by contracting and causing the biasing member to contract and the piston to be moved to the second position opening the air removal passageway to flow communication for drawing out air from the ink reservoir, the valve actuator responsive to termination of application of the electric current thereto by extending and allowing the biasing member to extend and move the piston to the first position closing the air removal passageway.

2. The system of claim 1 wherein the elongated bore defined in the manifold has an endless side wall and an inner end wall at an inner end of the bore terminating the endless sidewall in a spaced relation from the ink reservoir such that both the inner end wall and endless sidewall cross the air removal passageway and separate the passageway into an inner portion communicating between the ink reservoir and the inner end of the bore and an outer portion communicating between the inner end of the bore and the source of vacuum.

3. The system of claim 1 wherein the valve further has a plug disposed in the bore remote from the piston.

4. The system of claim 3 wherein the biasing member is a spring disposed through the bore between the piston and the plug.

5. The system of claim 4 wherein the spring is normally extended to bias the piston to the first position closing the air removal passageway while the application of electrical current to the valve actuator is terminated.

6. The system of claim 1 wherein the valve actuator includes a wire made of a electrically conductive material sensitive to change in temperature by the wire extending and contracting in length in response to increase and decrease in temperature of the material caused correspondingly by application and termination of application of electric current to the wire.

7. The system of claim 6 where the wire extends through the elongated bore and is connected at an inner end to the piston and anchored at a fixed position remote from the piston.

8. The system of claim 7 wherein the material of the wire is an alloy of nickel and titanium.

9. The system of claim 8 wherein the wire has a U-shaped configuration so as to define an inner bight portion at the inner end of the wire connected to the piston and a pair of leg portions connected to the bight portion and extending to outer ends at the fixed position remote from the piston.

10. The system of claim 9 wherein the valve further has a plug disposed in the bore at the fixed position remote from the piston with the outer ends of the wire engaged with the plug.

11. An inkjet printer maintenance system, comprising:

a manifold having an elongated air removal passageway defined in the manifold extending between one side of an ink reservoir and a location away from the ink reservoir for communicating flow of air from the ink reservoir via the air removal passageway;

a valve having an elongated bore communicating with the air removal passageway, a piston movable in the bore between first and second positions to correspondingly close and open the air removal passageway, and a biasing member extendible and contractible and normally extended so as to bias the piston to the first position closing the air removal passageway; and a valve actuator wire made of an electrically conductive material sensitive to change in temperature, the wire extending through the elongated bore and connected at an inner end to the piston and anchored at an outer end at a fixed position relative to the manifold, the valve actuator wire contractible and extendible in length in response increase and decrease in temperature correspondingly to application of an electric current thereto and termination of application of the electric current thereto such that the contraction in length of the wire contracts the biasing member and moves the piston to the second position opening the air removal passageway to flow communication for drawing out air from the ink reservoir, the extension in length of the wire allows the biasing member to extend and move the piston to the first position thereby closing the air removal passageway.

12. The system of claim 11 wherein the material of the valve actuator wire is transformable between a martensitic phase and austenitic phase so as to contract and extend in length by application and termination of application of the electrical current thereto.

13. The system of claim 11 wherein the wire has a U-shaped configuration so as to define an inner bight portion at the inner end of the wire connected to the piston and a pair of leg portions connected to the bight portion and extending to outer ends at the fixed position remote from the piston.

14. The system of claim 13 wherein the valve further has a plug disposed in the bore at the fixed position remote from the piston with the outer ends of the wire engaged with the plug.

15. The system of claim 11 wherein the valve actuator wire is an alloy of nickel and titanium.

16. An inkjet printer maintenance system, comprising:

a manifold having an elongated air removal passageway defined in the manifold extending between one side of an ink reservoir and a remote location from the ink reservoir for communicating flow of air from the ink reservoir via the air removal passageway to a source of vacuum at the remote location;

a valve actuatable for regulating communication of air flow through the air removal passageway between the ink reservoir and the source of vacuum, the valve having an elongated bore defined in the manifold with an endless side wall and an inner end wall at an inner end of the bore terminating the endless sidewall in a spaced relation from the ink reservoir such that both the inner end wall and endless sidewall cross the air removal passageway and separate the passageway into an inner portion communicating between the ink reservoir and the inner end of the bore and an outer portion communicating between the inner end of the bore and the source of vacuum, a plug located at an outer end of the bore closing the bore outer end, a piston movable in the bore between first and second positions to correspondingly close and open the air removal passageway between the inner and outer portions thereof, and a spring extending through the bore between the piston and the plug, the spring being normally extended to bias the piston to the first position closing the air removal passageway, the spring being contractible away from the piston; and a valve actuator extending through the elongated bore and connected to the piston, the valve actuator responsive to the application of an electric current thereto by contracting and causing the spring to contract and the piston to be moved to the second position opening the air removal passageway to flow communication between the first and second portions thereof for drawing out air from the ink reservoir, the valve actuator responsive to termination of application of the electric current thereto by extending and allowing the spring to extend and move the piston to the first position closing the air removal passageway.

17. The system of claim 16 wherein the valve also has a plunger shaft at an inner end connected to the piston and at an outer end slidably mounted in the plug.

18. The system of claim 17 wherein the spring is coiled about the plunger shaft.

19. The system of claim 16 wherein the valve actuator includes a wire made of an electrically conductive material sensitive to change in temperature by the wire extending and contracting in length in response to increase and decrease in temperature of the material caused correspondingly by application and termination of application of electric current to the wire.

20. The system of claim 19 wherein the material of the wire is an alloy of nickel and titanium.

* * * * *